US012466530B2

(12) United States Patent
Sakurada

(10) Patent No.: US 12,466,530 B2
(45) Date of Patent: Nov. 11, 2025

(54) WATERCRAFT PROPULSION SYSTEM, AND WATERCRAFT INCLUDING THE WATERCRAFT PROPULSION SYSTEM

(71) Applicant: YAMAHA HATSUDOKI KABUSHIKI KAISHA, Iwata (JP)

(72) Inventor: Kento Sakurada, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 248 days.

(21) Appl. No.: 18/387,085

(22) Filed: Nov. 6, 2023

(65) Prior Publication Data

US 2024/0149998 A1 May 9, 2024

(30) Foreign Application Priority Data

Nov. 8, 2022 (JP) ..... 2022-178982

(51) Int. Cl.
*B63H 20/12* (2006.01)
*B63H 20/00* (2006.01)

(52) U.S. Cl.
CPC ..... *B63H 20/12* (2013.01); *B63H 2020/003* (2013.01)

(58) Field of Classification Search
None
See application file for complete search history.

(56) References Cited

U.S. PATENT DOCUMENTS 6,032,087 A 2/2000 Yamamoto
2010/0126401 A1* 5/2010 Kokkinis ..... B63B 35/12 114/144 B
2010/0138083 A1* 6/2010 Kaji ..... B63H 25/02 701/21
2014/0046515 A1 2/2014 Mizutani
2019/0041857 A1* 2/2019 Tamura ..... G05D 1/0208
(Continued)

FOREIGN PATENT DOCUMENTS

JP 01-148696 A 6/1989
JP 2004042885 A * 2/2004 ..... B63H 25/42
(Continued)

OTHER PUBLICATIONS

Official Communication issued in corresponding European Patent Application No. 23208428.5, mailed on Apr. 29, 2024, 8 pages.

*Primary Examiner* — Amelia Vorce
(74) *Attorney, Agent, or Firm* — Keating & Bennett, LLP

(57) ABSTRACT

A watercraft propulsion system includes a bow thruster to generate a lateral propulsive force, a propulsion device on a stern of a hull and having a variable steering angle, and a controller configured or programmed to control the bow thruster and the propulsion device to perform a fixed point holding control to maintain a position and an azimuth of the hull. The fixed point holding control includes a translation mode in which the hull position is maintained by controlling the propulsive force of the propulsion device with the steering angle set to a translation mode steering angle and the hull azimuth is adjusted by controlling the propulsive force of the bow thruster, and a bow turning mode in which the hull azimuth is adjusted by controlling the propulsive forces of the bow thruster and the propulsion device with the steering angle set to a bow turning mode steering angle.

11 Claims, 12 Drawing Sheets

(56) References Cited

U.S. PATENT DOCUMENTS

| | | | | |
|---|---|---|---|---|
| 2020/0331578 | A1 | 10/2020 | Sakashita et al. | |
| 2020/0398964 | A1 | 12/2020 | Fujima et al. | |
| 2021/0286362 | A1* | 9/2021 | Malouf | G05D 1/0208 |
| 2024/0174331 | A1* | 5/2024 | Hara | B63H 21/21 |
| 2025/0153838 | A1* | 5/2025 | Tomita | B63H 25/38 |

FOREIGN PATENT DOCUMENTS

| | | | | | |
|---|---|---|---|---|---|
| JP | 2005-254956 | A | | 9/2005 | |
| JP | 2008110749 | A | | 5/2008 | |
| JP | 2009241738 | A | * | 10/2009 | B63H 25/42 |
| JP | 6664171 | B2 | * | 3/2020 | B63H 25/42 |
| JP | 2021187374 | A | * | 12/2021 | B63H 25/04 |
| WO | 2019/159289 | A1 | | 8/2019 | |
| WO | 2020069750 | A1 | | 4/2020 | |

* cited by examiner

WATERCRAFT PROPULSION SYSTEM, AND WATERCRAFT INCLUDING THE WATERCRAFT PROPULSION SYSTEM

CROSS REFERENCE TO RELATED APPLICATIONS

This application claims the benefit of priority to Japanese Patent Application No. 2022-178982 filed on Nov. 8, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

U.S. Pat. No. 6,032,087 discloses a ship position control system configured to maintain the hull of a small ship at a constant position at a constant azimuth. The small ship includes a bow thruster provided as a port-side/starboard-side propulsion device at the bow of the hull, a propeller that generates an anteroposterior propulsive force, and a main engine that rotates the propeller. A low speed device is incorporated in the clutch of the main engine, and an actuator is provided to mechanically operate the low speed device. The bow thruster and the actuator are controlled by a controller.

A GPS receiver that measures the position of the ship and an azimuth sensor that detects the orientation of the bow of the hull are provided on the hull. The controller actuates the bow thruster based on a position detection signal detected by the GPS receiver and an azimuth signal detected by the azimuth sensor, and actuates the low speed device via the actuator to control the position of the ship. Specifically, if a detection azimuth detected by the azimuth sensor is offset from a setting azimuth, the bow thruster is actuated to eliminate the azimuthal offset. Further, if a detection position measured by the GPS receiver is offset from a setting position, the low speed device is actuated to eliminate the positional offset. Thus, the hull is driven forward or in reverse by the rotation of the propeller.

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

The ship position control system of U.S. Pat. No. 6,032,087 eliminates the azimuthal offset by the bow thruster, and eliminates the positional offset by the anteroposterior propulsive force of the propeller. The positional offset of the hull on water typically includes not only an anteroposterior positional offset component but also a lateral positional offset component. In U.S. Pat. No. 6,032,087, there is no detailed description on elimination of the lateral positional offset component.

Studies conducted by the inventor reveal that the use of the bow thruster alone is advantageous for the elimination of the azimuthal offset in some cases and the use of the propulsive force of an additional propulsion device as well as the propulsive force of the bow thruster is advantageous for the elimination of the azimuthal offset in other cases. Therefore, a fixed point holding technique to maintain the position and the azimuth of the hull still has room for improvement.

Preferred embodiments of the present invention provide watercraft propulsion systems that are each able to highly precisely maintain the position and the azimuth of hulls of watercraft, and watercraft including the watercraft propulsion systems.

In order to overcome the previously unrecognized and unsolved challenges described above, a preferred embodiment of the present invention provides a watercraft propulsion system including a bow thruster provided at a bow of a hull to generate a lateral propulsive force, a propulsion device provided on a stern of the hull and having a variable steering angle, and a controller configured or programmed to control the propulsive force of the bow thruster, and control the propulsive force and the steering angle of the propulsion device in order to perform a fixed point holding control to maintain a position and an azimuth of the hull. The fixed point holding control includes a translation mode in which the hull position is maintained by controlling the propulsive force of the propulsion device with the steering angle of the propulsion device set to a translation mode steering angle to translate the hull and the hull azimuth is adjusted by controlling the propulsive force of the bow thruster, and a bow turning mode in which the hull azimuth is adjusted by controlling the propulsive forces of the bow thruster and the propulsion device with the steering angle of the propulsion device set to a bow turning mode steering angle to turn the bow of the hull.

With this arrangement, the fixed point holding control maintains the position and the azimuth of the hull by controlling the propulsive force of the bow thruster and the propulsive force and the steering angle of the propulsion device provided on the stern. The fixed point holding control includes the translation mode and the bow turning mode. In the translation mode, the steering angle of the propulsion device is set to the translation mode steering angle to translate the hull. In the bow turning mode, the steering angle of the propulsion device is set to the bow turning mode steering angle to turn the bow of the hull. Therefore, the propulsive force of the propulsion device provided on the stern acts on the hull mainly to translate the hull in the translation mode, and acts on the hull mainly to turn the bow of the hull in the bow turning mode. In the translation mode, the hull azimuth is adjusted mainly by utilizing the propulsive force of the bow thruster. Therefore, the position and the azimuth of the hull are highly precisely maintained by properly allocating the functions of the bow thruster and the propulsion device provided on the stern. That is, there is substantially no need to share the propulsive force of the propulsion device provided on the stern to adjust the hull azimuth, so that the hull position can be highly precisely adjusted. Further, the propulsive force of the bow thruster effectively applies a moment to the hull so that the hull azimuth is also highly precisely adjusted. When the hull azimuth is significantly offset from a target azimuth, on the other hand, the bow turning mode is more advantageous. In the bow turning mode, a greater moment can be applied to the hull by the propulsive force of the bow thruster and the propulsive force of the propulsion device provided on the stern, so that the azimuth can be speedily adjusted. Even if the adjustment of the azimuth in the bow turning mode is needed, therefore, the control in the bow turning mode can be finished in a shorter period of time. During the bow turning mode, the hull position is liable to be offset due to external disturbances or the like, but the positional offset of the hull can be reduced or minimized by finishing the bow turning mode in a short period of time. This makes it possible to highly precisely adjust the position and the azimuth of the hull in the translation mode while reducing the time required for the control in the bow turning mode. As a result, the fixed point holding operation can be performed to highly precisely maintain the position and the azimuth of the hull.

In a preferred embodiment of the present invention, the controller is configured or programmed to switch between the translation mode and the bow turning mode based on a predetermined switching condition in the fixed point holding control. With this arrangement, the mode switching between the translation mode and the bow turning mode can be properly achieved by properly setting the switching condition such that the fixed point holding operation can be performed to highly precisely maintain the position and the azimuth of the hull.

In a preferred embodiment of the present invention, the switching condition includes a bow turning mode switching condition to switch from the translation mode to the bow turning mode, and the bow turning mode switching condition includes at least one of a condition such that the positional offset of the hull from a target position is less than a first threshold (hereinafter referred to as "first switching condition"), a condition such that a propulsive force requirement value to translate the hull is less than a second threshold (hereinafter referred to as "second switching condition"), or a condition such that a bow turning requirement value to turn the bow of the hull or the azimuthal offset of the hull from a target azimuth is not less than a third threshold (hereinafter referred to as "third switching condition").

If the movement speed of the hull is reduced, the course keeping performance of the hull is deteriorated. This is liable to occur when the positional offset of the hull from the target position is reduced (first switching condition) or when the propulsive force requirement value to translate the hull is reduced (second switching condition). Further, if the azimuthal offset of the hull from the target azimuth is increased, the bow turning requirement value is increased (third switching condition). Therefore, at least one of the first, second, or third switching conditions to be satisfied in these situations is used as the bow turning mode switching condition such that the translation mode can be properly switched to the bow turning mode.

In a preferred embodiment of the present invention, the bow turning mode switching condition includes a condition such that the first switching condition, the second switching condition, and the third switching condition are continuously satisfied for not shorter than a predetermined time period. With this arrangement, the translation mode is switched to the bow turning mode, if all the first, second, and third switching conditions are continuously satisfied for not shorter than the predetermined time period. Therefore, the mode is less liable to be switched to the bow turning mode in which the positional offset is likely to occur, so that the fixed point holding control is performed dominantly in the translation mode in which the position and the azimuth of the hull can be highly precisely adjusted.

In a preferred embodiment of the present invention, the switching condition includes a translation mode switching condition to switch from the bow turning mode to the translation mode, and the translation mode switching condition includes at least one of a condition such that the bow turning requirement value to turn the bow of the hull or the azimuthal offset of the hull from the target azimuth is not greater than a fourth threshold (hereinafter referred to as "fourth switching condition"), and a condition such that the propulsive force requirement value to translate the hull is not less than a fifth threshold (hereinafter referred to as "fifth switching condition").

If the bow turning requirement value is reduced or the azimuthal offset of the hull from the target azimuth is reduced (fourth switching condition), it is no longer necessary to apply a greater bow turning moment in the bow turning mode. Further, when the propulsive force requirement value for translation of the hull is great (fifth switching condition), the translation mode is advantageous in which the positional offset can be effectively compensated for. Therefore, at least one of the fourth and fifth switching conditions to be satisfied in these situations is used as the translation mode switching condition such that the bow turning mode can be properly switched to the translation mode.

In a preferred embodiment of the present invention, the bow turning mode is switched to the translation mode if at least one of the fourth switching condition or the fifth switching condition is satisfied. With this arrangement, the bow turning mode is switched to the translation mode if one or more of the fourth switching condition and the fifth switching condition are satisfied. Therefore, the bow turning mode in which the positional offset is likely to occur is liable to be switched to the translation mode in which the position and the azimuth of the hull can be highly precisely adjusted. Therefore, the fixed point holding control is performed dominantly in the translation mode. Thus, the fixed point holding operation can be performed to highly precisely maintain the position and the azimuth of the hull.

In a preferred embodiment of the present invention, the propulsion device includes at least two propulsion devices each having a variable steering angle, and the translation mode steering angle includes translation mode steering angles such that the propulsive force action lines of the two propulsion devices cross each other in the hull. The steering angles of the two propulsion devices are respectively controlled to the translation mode steering angles such that the hull can be translated by the resultant force of the propulsive forces of the propulsion devices (resultant propulsive force).

In a preferred embodiment of the present invention, the translation mode steering angle includes translation mode steering angles such that the propulsive force action lines of the two propulsion devices cross each other at a position closer to the stern than to a turning center of the hull. With this arrangement, where the translation mode steering angles are great with respect to the anteroposterior direction of the hull, the resultant propulsive force of the two propulsion devices can have a greater transverse component. This makes it possible to apply a greater propulsive force to the hull. On the other hand, the resultant propulsive force of the two propulsion devices acts on the hull at a position rearward of the turning center of the hull, so that a moment occurs about the turning center. The propulsive force of the bow thruster is controlled to entirely or partially cancel the moment thus making it possible to control the bow turning of the hull. In addition, the propulsive force of the bow thruster can also be used to translate the hull. Thus, a greater propulsive force can be provided for translation of the hull. This increases the precision of the position holding operation.

In a preferred embodiment of the present invention, the propulsion device includes at least two propulsion devices each having a variable steering angle, and the bow turning mode steering angle includes bow turning mode steering angles such that the propulsive force action lines of the two propulsion devices are parallel or substantially parallel to each other. With this arrangement, the propulsive forces of the two propulsion devices act on the hull anteroposteriorly of the hull with the steering angles of the two propulsion devices respectively set to the bow turning mode steering angles such that a greater bow turning moment can be applied to the hull. Thus, the hull azimuth can be speedily adjusted to the target azimuth.

In a preferred embodiment of the present invention, the propulsion device includes at least two propulsion devices each having a variable steering angle, and one of the two propulsion devices is driven forward and the other of the two propulsion devices is driven in reverse in the translation mode and the bow turning mode.

Where the two propulsion devices are driven in the opposite directions in the translation mode, the resultant propulsive force of the two propulsion devices can have a greater transverse component acting transversely of the hull. Thus, a greater propulsive force can be applied to the hull to translate the hull, so that the position of the hull can be speedily adjusted to the target position. Where the two propulsion devices are driven in the opposite directions in the bow turning mode, on the other hand, the two propulsion devices apply moments in the same direction about the turning center of the hull. Thus, a greater bow turning moment can be applied to the hull so that the azimuth of the hull can be speedily adjusted to the target azimuth.

Another preferred embodiment of the present invention provides a watercraft, which includes a hull, and a watercraft propulsion system provided on the hull and including any of the aforementioned features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
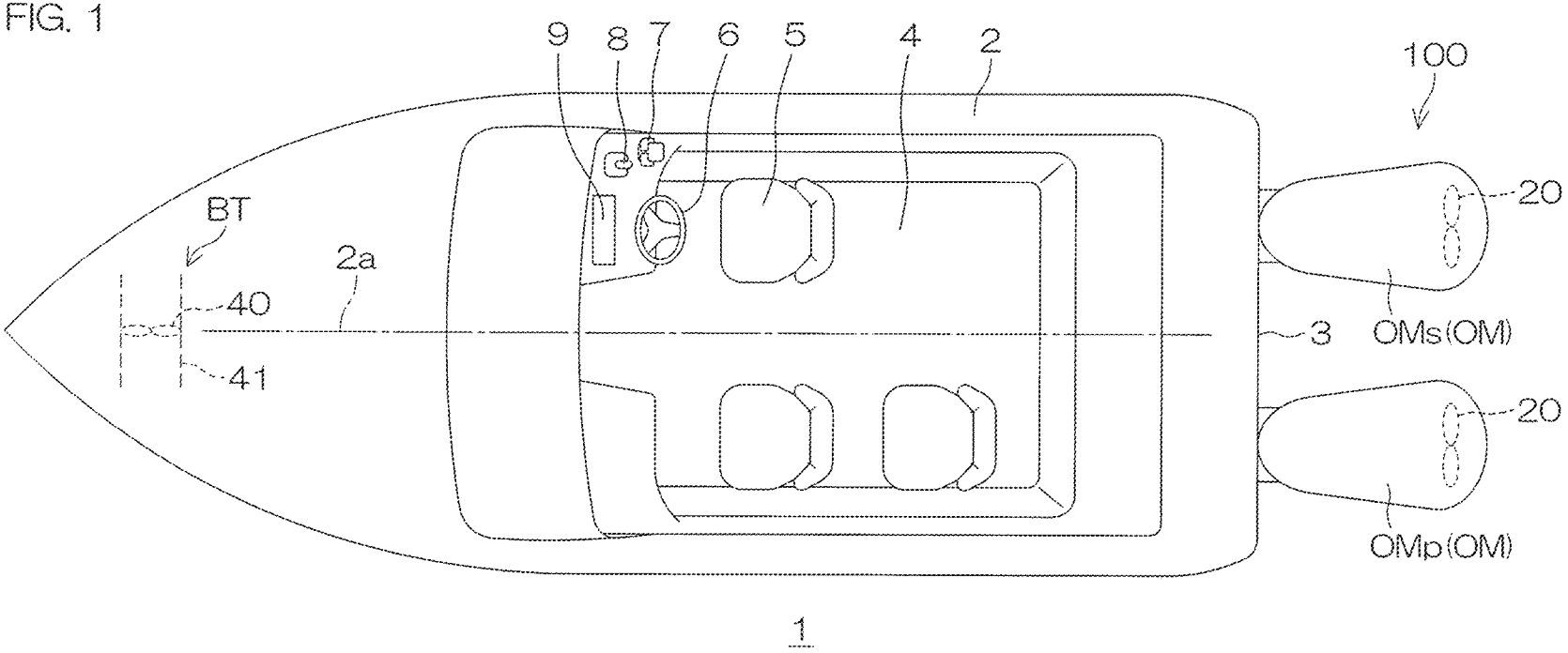
FIG. 1 is a plan view showing an exemplary construction of a watercraft mounted with a watercraft propulsion system according to a preferred embodiment of the present invention.

FIG. 1 is a plan view showing an exemplary construction of a watercraft 1 mounted with a watercraft propulsion system 100 according to a preferred embodiment of the present invention. The watercraft 1 includes a hull 2, a bow thruster BT provided at the bow of the hull 2 to generate a lateral propulsive force, and outboard motors OM (examples of the propulsion device) provided on the stern 3 of the hull 2 and each having a variable steering angle. In this preferred embodiment, a plurality of outboard motors OM, more specifically, two outboard motors OM are provided on the stern 3.

The two outboard motors OM are disposed side by side transversely of the hull 2 on the stern 3. For discrimination between the two outboard motors OM, one of the outboard motors OM disposed rightward relative to the other outboard motor OM is referred to as "starboard-side outboard motor OMs" and the other outboard motor OM disposed leftward relative to the one outboard motor OM is referred to as "port-side outboard motor OMp." In this example, the starboard-side outboard motor OMs is disposed on the right side of a center line 2*a* extending anteroposteriorly of the hull 2, and the port-side outboard motor OMp is disposed on the left side of the center line 2*a*. More specifically, the starboard-side outboard motor OMs and the port-side outboard motor OMp are disposed symmetrically with respect to the center line 2*a*.

The outboard motors OM each include a propeller 20 located underwater, and are each configured to generate a propulsive force by the rotation of the propeller 20 and apply the propulsive force to the hull 2. The outboard motors OM are each attached to the stern 3 pivotably leftward and rightward such that the direction of the propulsive force generated by the propeller 20 is changed leftward and rightward. The steering angle is defined, for example, as an angle between the direction of the propulsive force generated by the propeller 20 and an anteroposterior reference direction parallel to the center line 2*a*. The outboard motors OM are each configured to be pivoted leftward and rightward by a steering mechanism 26 thereof (see FIG. 2) to change the steering angle. When the propulsive force direction is parallel to the anteroposterior direction, the steering angle is zero. When the rear end of the outboard motor OM is directed rightward, the steering angle may be expressed with a positive sign. When the rear end of the outboard motor OM is directed leftward, the steering angle may be expressed with a negative sign.

The bow thruster BT includes a propeller 40 disposed in a tubular tunnel 41 extending through the bow portion of the hull 2 transversely of the hull 2. The propeller 40 is rotatable in a forward rotation direction and a reverse rotation direction, i.e., is bidirectionally rotatable such that the bow thruster BT can apply a rightward or leftward propulsive force to the hull 2. In this preferred embodiment, the direction of the propulsive force to be generated by the bow thruster BT cannot be set to a direction other than the rightward direction and the leftward direction.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator to be operated by a user (an operator) to change the course of the watercraft 1. The remote control lever 7 is an operator to be operated by the user to change the magnitudes (outputs) and the directions (forward or reverse directions) of the propulsive forces of the outboard motors OM, and corresponds to an acceleration operator. The joystick 8 is an operator to be operated instead of the steering wheel 6 and the remote control lever 7 by the user during a watercraft maneuvering operation. An operator 45 (see FIG. 2) dedicated for the operation of the bow thruster BT may be provided in addition to the aforementioned operators.

Figure 2:
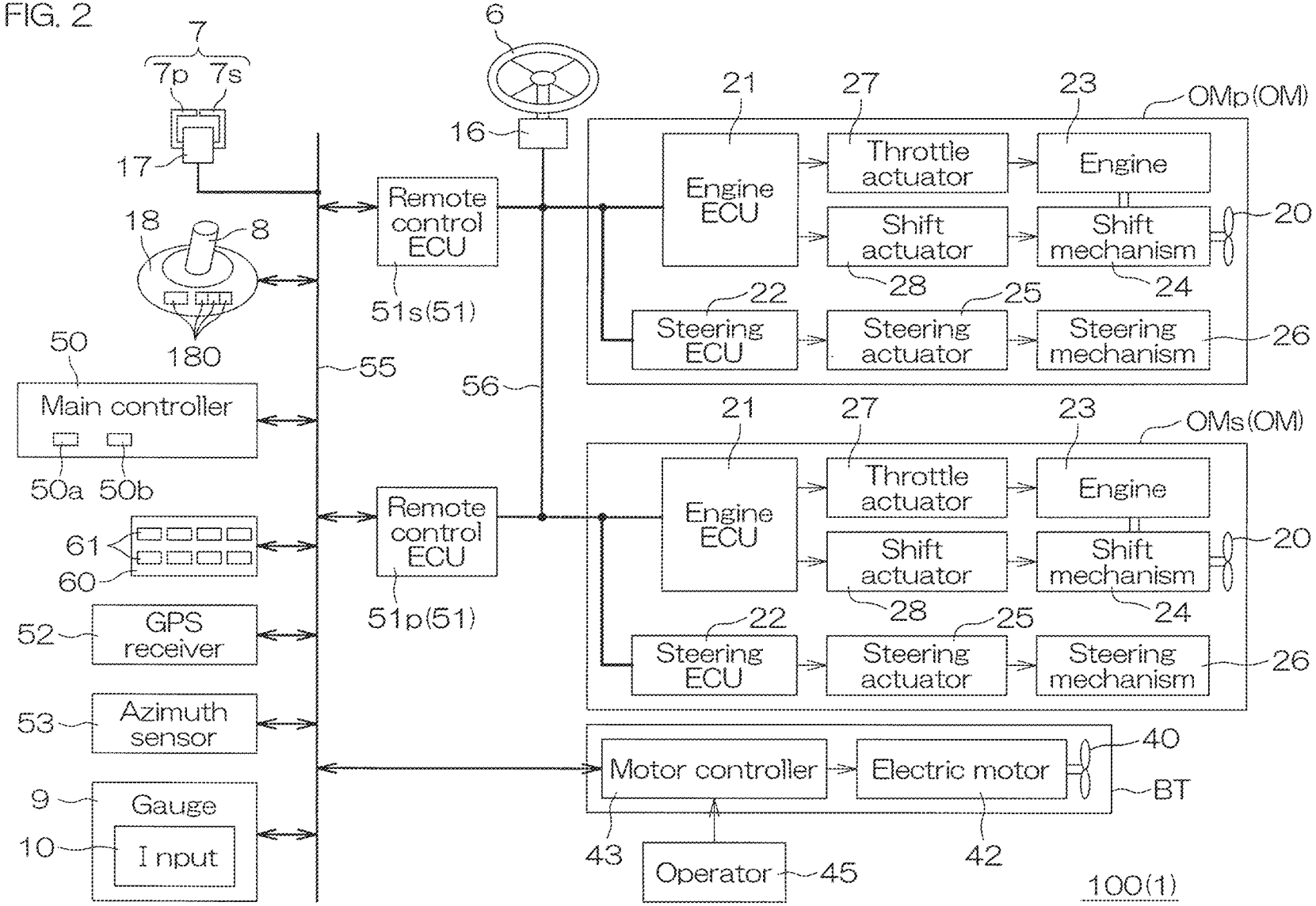
FIG. 2 is a block diagram showing a configuration of the watercraft propulsion system by way of example.

FIG. 2 is a block diagram showing the configuration of the watercraft propulsion system 100 provided in the watercraft 1 by way of example. The watercraft propulsion system 100 includes the two outboard motors OM and the bow thruster BT. The outboard motors OM may each be an engine outboard motor or an electric outboard motor. In FIG. 2, the outboard motors OM are engine outboard motors by way of example.

The outboard motors OM each include an engine ECU (Electronic Control Unit) 21, a steering ECU 22, an engine 23, a shift mechanism 24, a propeller 20, the steering mechanism 26 and the like. Power generated by the engine 23 is transmitted to the propeller 20 via the shift mechanism 24. The steering mechanism 26 is configured to pivot the body of the outboard motor OM leftward and rightward with respect to the hull 2 (see FIG. 1) to change the direction of the propulsive force generated by the outboard motor OM leftward and rightward. The shift mechanism 24 is configured to select a shift position from a forward shift position, a reverse shift position, and a neutral shift position. With the shift position set to the forward shift position, the propeller 20 is rotated in a forward rotation direction by the transmission of the rotation of the engine 23 such that the outboard motor OM is brought into a forward drive state to generate a forward propulsive force. With the shift position set to the reverse shift position, the propeller 20 is rotated in a reverse rotation direction by the transmission of the rotation of the engine 23 such that the outboard motor OM is brought into a reverse drive state to generate a reverse propulsive force. With the shift position set to the neutral shift position, the power transmission between the engine 23 and the propeller 20 is interrupted such that the outboard motor OM is brought into an idling state.

The outboard motors OM each further include a throttle actuator 27 and a shift actuator 28, which are controlled by the engine ECU 21. The throttle actuator 27 is an electric actuator (typically including an electric motor) that actuates the throttle valve (not shown) of the engine 23. The shift actuator 28 actuates the shift mechanism 24. The outboard motors OM each further include a steering actuator 25 to be controlled by the steering ECU 22. The steering actuator 25 is the drive source of the steering mechanism 26, and typically includes an electric motor. The steering actuator 25 may include a hydraulic device of electric pump type.

The bow thruster BT includes the propeller 40, an electric motor 42 that drives the propeller 40, and a motor controller 43 that controls the electric motor 42.

The watercraft propulsion system 100 further includes a main controller 50. The main controller 50 includes a processor 50*a* and a memory 50*b*, and is configured so that the processor 50*a* executes a program stored in the memory 50*b* to perform a plurality of functions. The main controller 50 is connected to an onboard network 55 (CAN: Control Area Network) provided in the hull 2. A remote control unit 17, two remote control ECUs 51, a joystick unit 18, a GPS (Global Positioning System) receiver 52, an azimuth sensor 53 and the like are connected to the onboard network 55.

The two remote control ECUs 51 (51*s*, 51*p*) are provided in association with the two outboard motors OM (OMs, OMp), respectively, and are connected to the onboard network 55. The engine ECU 21 and the steering ECU 22 of the starboard-side outboard motor OMs, and the engine ECU 21 and the steering ECU 22 of the port-side outboard motor OMp are connected to the corresponding remote control ECUs 51*s*, 51*p* via an outboard motor control network 56. The main controller 50 transmits and receives signals to/from various units connected to the onboard network 55 to control the outboard motors OM and the bow thruster BT, and further controls other units. The main controller 50 includes a plurality of control modes, and controls the units in predetermined manners according to the respective control modes.

A steering wheel unit 16 is connected to the outboard motor control network 56. The steering wheel unit 16 outputs an operation angle signal indicating the operation angle of the steering wheel 6 to the outboard motor control network 56. The operation angle signal is received by the remote control ECUs 51 and the steering ECUs 22. In response to the operation angle signal generated by the steering wheel unit 16 or steering angle commands respectively generated by the remote control ECUs 51, the steering ECUs 22 of the outboard motors OM respectively control the steering actuators 25 to control the steering angles of the outboard motors OM.

The remote control unit 17 generates an operation position signal indicating the operation position of the remote control lever 7. The remote control unit 17 includes a starboard-side remote control lever 7*s* and a port-side remote control lever 7*p* respectively provided in association with the starboard-side outboard motor OMs and the port-side outboard motor OMp.

The joystick unit 18 generates an operation position signal indicating the operation position of the joystick 8, and generates an operation signal indicating the operation of any of operation buttons 180 provided in the joystick unit 18.

The remote control ECUs 51 each output a propulsive force command to the corresponding engine ECU 21 via the outboard motor control network 56. The propulsive force command includes a shift command indicating the shift position, and an output command indicating an engine output (specifically, an engine rotation speed). Further, the remote control ECUs 51 each output the steering angle command to the corresponding steering ECU 22 via the outboard motor control network 56.

The remote control ECUs 51 each perform different control operations according to different control modes of the main controller 50. In a control mode for watercraft maneuvering with the use of the steering wheel 6 and the remote control lever 7, for example, the remote control ECUs 51 each generate the propulsive force command (the shift command and the output command) according to the operation position signal generated by the remote control unit 17, and each apply the propulsive force command (the shift command and the output command) to the corresponding engine ECU 21. Further, the remote control ECUs 51 each command the corresponding steering ECU 22 to conform to the operation angle signal generated by the steering wheel unit 16. In a control mode for watercraft maneuvering without the use of the steering wheel 6 and the remote control lever 7, on the other hand, the remote control ECUs 51 each conform to commands applied by the main controller 50. That is, the main controller 50 generates the propulsive force command (the shift command and the output command) and the steering angle command, and the remote control ECUs 51 each output the propulsive force command (the shift command and the output command) and the steering angle command to the engine ECU 21 and the steering ECU 22, respectively. In a control mode for watercraft maneuvering with the use of the joystick 8 (joystick mode), for example, the main controller 50 generates the propulsive force command (the shift command and the output command) and the steering angle command according to the signals generated by the joystick unit 18. The magnitude and the direction (the forward direction or the reverse direction) of the propulsive force and the steering angle of each of the outboard motors OM are controlled according to the propulsive force command (the shift command and the output command) and the steering angle command thus generated.

The engine ECU 21 of each of the outboard motors OM drives the shift actuator 28 according to the shift command to control the shift position, and drives the throttle actuator 27 according to the output command to control the throttle opening degree of the engine 23. The steering ECU 22 of each of the outboard motors OM controls the steering actuator 25 according to the steering angle command to control the steering angle of the outboard motor OM.

The motor controller 43 of the bow thruster BT is connected to the onboard network 55, and is configured to actuate the electric motor 42 in response to a command applied from the main controller 50. The motor controller 43 may be connected to the onboard network 55 via a gateway (not shown). The main controller 50 applies a propulsive force command to the motor controller 43. The propulsive force command includes a shift command and an output command. The shift command is a rotation direction command that indicates the stop, the forward rotation, or the reverse rotation of the propeller 20. The output command is a rotation speed command that indicates a propulsive force to be generated, specifically, a target rotation speed value. The motor controller 43 controls the rotation direction and the rotation speed of the electric motor 42 according to the shift command (rotation direction command) and the output command.

In this example, the operator 45 dedicated for the bow thruster BT is connected to the motor controller 43. The user can adjust the rotation direction and the rotation speed of the bow thruster BT by operating the operator 45.

The GPS receiver 52 is an exemplary position detecting device. The GPS receiver 52 detects the position of the watercraft 1 by receiving radio waves from an artificial satellite orbiting the earth, and outputs position data indicating the position of the watercraft 1 and speed data indicating the moving speed of the watercraft 1. The main controller 50 acquires the position data and the speed data, which are used to control and display the position and/or the azimuth of the watercraft 1.

The azimuth sensor 53 detects the azimuth of the watercraft 1, and generates azimuth data, which is used by the main controller 50.

The gauge 9 is also connected to the onboard network 55. The gauge 9 is a display device that displays various information for the watercraft maneuvering. The gauge 9 can communicate, for example, with the main controller 50, the remote control ECUs 51 and the motor controller 43. Thus, the gauge 9 can display information such as the operation states of the outboard motors OM, the operation state of the bow thruster BT, and the position and/or the azimuth of the watercraft 1. The gauge 9 may include an input device 10 such as a touch panel and buttons. The input device 10 may be operated by the user to set various settings and provide various commands such that operation signals are outputted to the onboard network 55. An additional network other than the onboard network 55 may be provided to transmit display control signals related to the gauge 9.

An application switch panel 60 is connected to the onboard network 55. The application switch panel 60 includes a plurality of function switches 61 to be operated to apply predefined function commands. For example, the function switches 61 may include switches for automatic watercraft maneuvering commands. More specifically, a command for a bow holding mode (Heading Hold) in which an automatic steering operation is performed to maintain the bow azimuth during forward sailing may be assigned to one of the function switches 61, and a command for a straight sailing holding mode (Course Hold) in which an automatic steering operation is performed to maintain the bow azimuth and a straight course during forward sailing may be assigned to another of the function switches 61. Further, a command for a checkpoint following mode (Track Point™) in which an automatic steering operation is performed to follow a course (route) passing through specified checkpoints may be assigned to further another of the function switches 61, and a command for a pattern sailing mode (Pattern Steer) in which an automatic steering operation is performed to follow a predetermined sailing pattern (zig-zag pattern, spiral pattern or the like) may be assigned to still another of the function switches 61.

Figure 3:
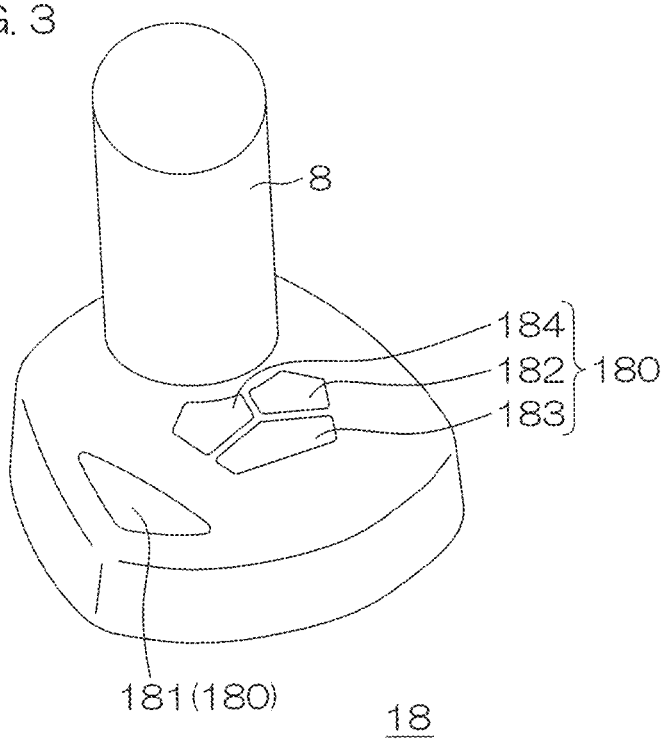
FIG. 3 is a perspective view showing the structure of a joystick unit by way of example.

FIG. 3 is a perspective view showing the structure of the joystick unit 18 by way of example. The joystick unit 18 includes the joystick 8, which can be inclined forward, backward, leftward, and rightward (i.e., in all 360-degree directions) and can be pivoted (twisted) about its axis. In this example, the joystick unit 18 further includes the operation buttons 180. The operation buttons 180 include a joystick button 181 and holding mode setting buttons 182 to 184.

The joystick button 181 is an operator to be operated by the user to select a control mode (watercraft maneuvering mode) utilizing the joystick 8, i.e., the joystick mode.

The holding mode setting buttons 182, 183, 184 are operation buttons to be operated by the user to select position/azimuth holding control modes (examples of an automatic watercraft maneuvering mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 50 can be classified into an ordinary mode, the joystick mode, or the automatic watercraft maneuvering mode in terms of the operation system.

In the ordinary mode, a steering control operation is performed according to the operation angle signal generated by the steering wheel unit 16, and a propulsive force control operation is performed according to the operation signal (operation position signal) of the remote control lever 7. In this preferred embodiment, the ordinary mode is a default control mode of the main controller 50. In the steering control operation, specifically, the steering ECUs 22 of the outboard motors OM respectively drive the steering actuators 25 according to the operation angle signal generated by the steering wheel unit 16 or the steering angle commands generated by the remote control ECUs 51. Thus, the bodies of the outboard motors OM are steered leftward and rightward such that the propulsive force directions of the outboard motors OM are changed leftward and rightward with respect to the hull 2. In the propulsive force control operation, specifically, the engine ECUs 21 of the outboard motors OM drive the shift actuators 28 and the throttle actuators 27 according to the propulsive force commands (the shift commands and the output commands) applied from the remote control ECUs 51 to the engine ECUs 21. Thus, the shift positions of the outboard motors OM are each set to the forward shift position, the reverse shift position, or the neutral shift position, and the engine outputs (specifically, the engine rotation speeds) of the outboard motors OM are changed.

In the joystick mode, the steering control operation and the propulsive force control operation are performed according to the operation signal of the joystick 8 of the joystick unit 18.

In the joystick mode, the steering control operation and the propulsive force control operation are performed on the outboard motors OM if the outboard motors OM are in a propulsive force generatable state. That is, the main controller 50 applies the steering angle command and the propulsive force command to the remote control ECUs 51, and the remote control ECUs 51 apply the steering angle command to the steering ECUs 22 and apply the propulsive force command to the engine ECUs 21.

In the automatic watercraft maneuvering mode, the steering control operation and/or the propulsive force control operation are automatically performed by the functions of the main controller 50 and the like without the operation of the steering wheel 6, the remote control lever 7, and the joystick 8. That is, an automatic watercraft maneuvering operation is performed. The automatic watercraft maneuvering operation includes an automatic watercraft maneuvering operation to be performed on a sailing basis during sailing, and an automatic watercraft maneuvering operation to be performed on a position/azimuth holding basis to maintain the position and/or the azimuth. Examples of the automatic watercraft maneuvering operation on the sailing basis include the automatic steering operations to be selected by operating the function switches 61. Examples of the automatic watercraft maneuvering operation on the position/azimuth holding basis include watercraft maneuvering operations to be performed in the fixed point holding mode, the position holding mode and the azimuth holding mode which are respectively selected by operating the holding mode setting buttons 182, 183, 184.

In this preferred embodiment, a cooperative mode in which the outboard motors OM and the bow thruster BT cooperate to achieve an intended hull behavior or a non-cooperative mode in which the outboard motors OM and the bow thruster BT do not cooperate can be selected in the joystick mode and the automatic watercraft maneuvering mode. A selection operator to be operated by the user to select the cooperative mode or the non-cooperative mode, for example, may be assigned to any of the function switches 61 provided on the application switch panel 60. In the cooperative mode, the main controller 50 performs the steering control operation and the propulsive force control operation on the outboard motors OM and, in addition, performs the propulsive force control operation on the bow thruster BT.

Figure 4A:
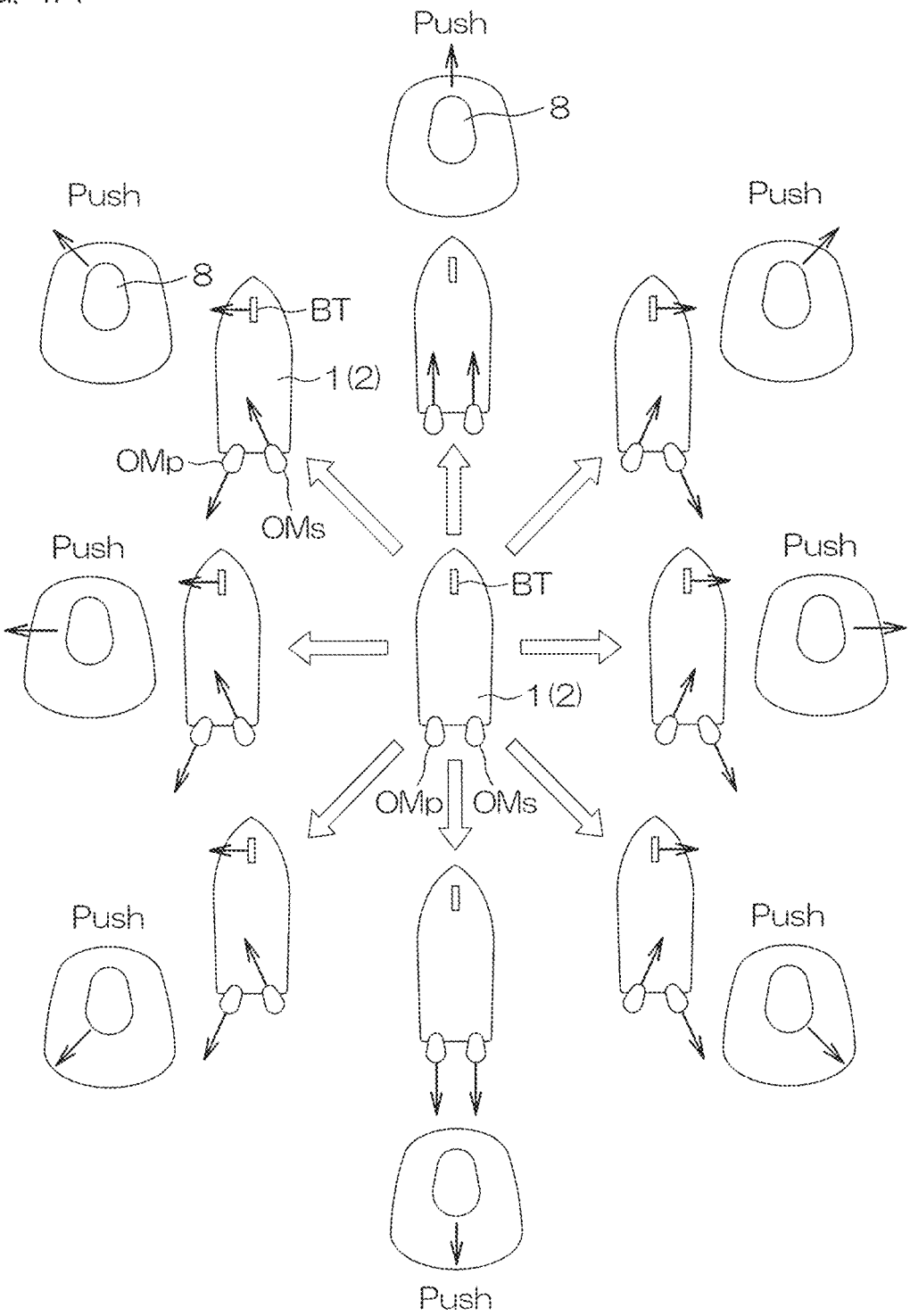
FIG. 4A is a diagram for describing a joystick mode in a cooperative mode showing operation states of a joystick and corresponding hull behaviors (translation).
Figure 4B:
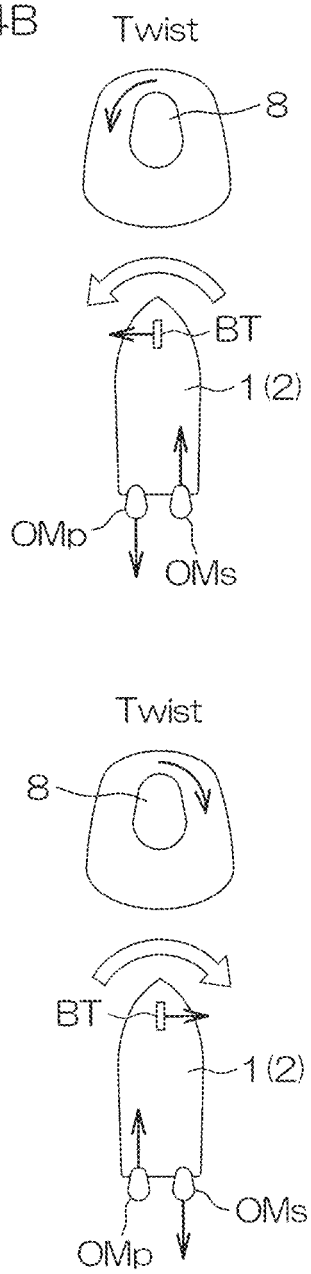
FIG. 4B is a diagram for describing the joystick mode in the cooperative mode showing operation states of the joystick and corresponding hull behaviors (fixed point bow turning).

FIGS. 4A and 4B are diagrams for describing the joystick mode in the cooperative mode showing operation states of the joystick 8 and corresponding behaviors of the hull 2. If the joystick mode is selected by operating the joystick button 181, the main controller 50 performs a joystick mode control operation. If the cooperative mode is selected before the joystick mode is selected, or if the cooperative mode is selected after the joystick mode is selected, the main controller 50 performs the joystick mode control operation according to the cooperative mode. If the cooperative mode is not selected, the main controller 50 performs the joystick mode control operation according to the non-cooperative mode.

The main controller 50 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 50 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 50 and inputted to the remote control ECUs 51, and the propulsive force command is inputted to the motor controller 43 of the bow thruster BT. The remote control ECUs 51 transmit the steering angle command to the steering ECUs 22 of the respective outboard motors OM, and transmit the propulsive force command to the engine ECUs 21 of the respective outboard motors OM. Thus, the outboard motors OM are respectively steered to steering angles according to the steering command, and the shift positions and the engine rotation speeds of the respective outboard motors OM are controlled to generate propulsive forces according to the propulsive force command. Further, the motor controller 43 controls the rotation direction and the rotation speed of the electric motor 42 so as to generate a propulsive force having a direction and a magnitude according to the propulsive force command.

When the joystick 8 is inclined without being pivoted in the joystick mode, the hull 2 is moved in a direction corresponding to the inclination direction of the joystick 8 without the bow turning, i.e., with its azimuth maintained. That is, the hull 2 is in a hull behavior of translation movement. Examples of the translation movement are shown in FIG. 4A.

Figure 5A:
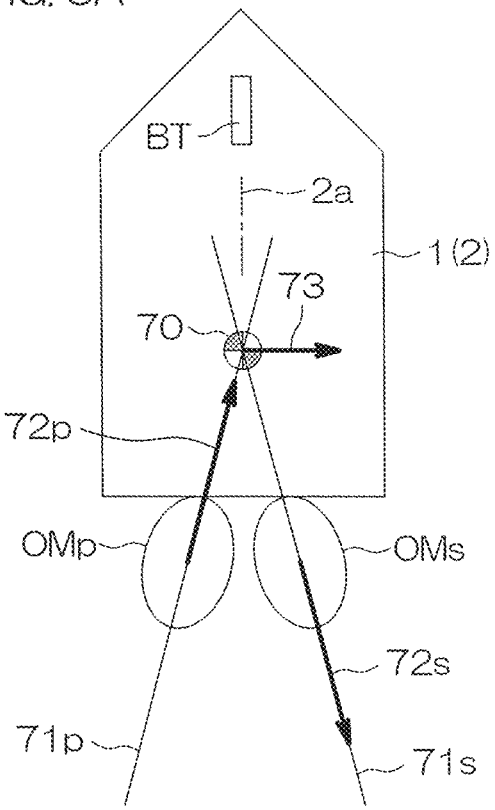
FIGS. 5A and 5B are diagrams for describing examples of the translation to be respectively observed in a non-cooperative mode and in the cooperative mode.
Figure 5B:
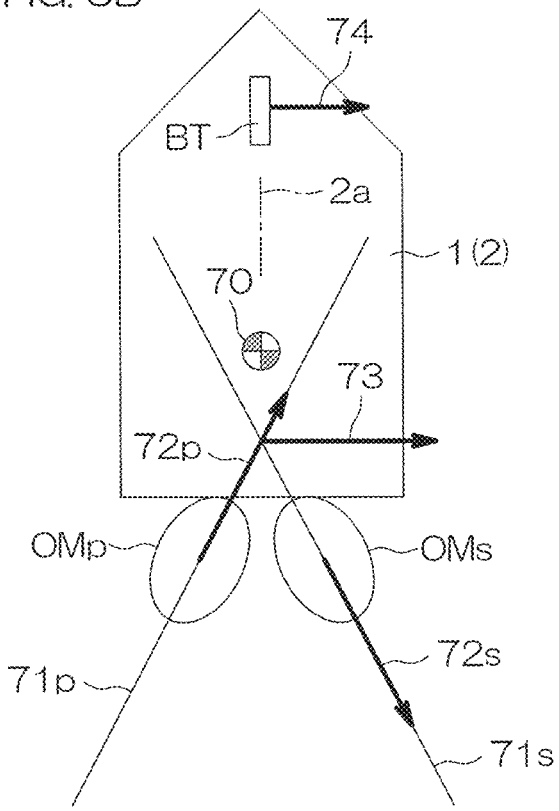

The translation movement is typically achieved by driving one of the outboard motors OM forward and driving the other outboard motor OM in reverse with the propulsive force action lines 71*s*, 71*p* of the two outboard motors OMs, OMp crossing each other in the hull 2 as shown in FIGS. 5A and 5B. The propulsive force action lines 71*s*, 71*p* respectively extend through the action points of the propulsive forces 72*s*, 72*p* of the outboard motors OMs, OMp along the directions of the propulsive forces 72*s*, 72*p*. The two outboard motors OM are steered in an inverted V-shaped orientation as seen in plan (in a so-called toe-in orientation). The steering angles of the outboard motors OM observed when the two outboard motors OM are thus steered in the inverted V-shaped orientation with their propulsive force action lines 71*s*, 71*p* crossing each other in the hull 2 are hereinafter referred to as "translation mode steering angles."

In the non-cooperative mode, as shown in FIG. 5A, the bow thruster BT is in a stop state, and the steering angles of the two outboard motors OM are controlled so that the propulsive force action lines 71*s*, 71*p* of the outboard motors OM cross each other at the turning center 70 (resistance center) of the hull 2. Thus, a resultant propulsive force 73 which is the resultant force of the propulsive forces 72*s*, 72*p* generated by the two outboard motors OMs, OMp causes the hull 2 to translate (to move laterally) without applying a moment to the hull 2.

In the cooperative mode, on the other hand, the bow thruster BT is actuated to generate a propulsive force as shown in FIG. 5B. The steering angles of the two outboard motors OM are controlled so that the propulsive force action lines 71*s*, 71*p* of the outboard motors OM cross each other on the rear side of the turning center 70 (resistance center) of the hull 2. The action point of the resultant propulsive force 73 of the propulsive forces 72*s*, 72*p* generated by the two outboard motors OM is the intersection of the propulsive force action lines 71*s*, 71*p*, so that a moment is applied to the hull 2 about the turning center 70. On the other hand, the propulsive force 74 generated by the bow thruster BT also applies a moment to the hull 2 about the turning center 70. Therefore, the propulsive forces 72*s*, 72*p*, 74 of the outboard motors OM and the bow thruster BT are controlled so as to balance the moments applied to the hull 2 by the resultant propulsive force 73 of the two outboard motors OM and the propulsive force 74 of the bow thruster BT. Thus, the hull 2 translates (moves laterally) without the bow turning. In the cooperative mode in which the bow thruster BT and the two outboard motors OM are used in combination, the overall propulsive force contributable to the translation is greater than in the non-cooperative mode, making it possible to smoothly translate the hull 2.

In this preferred embodiment, the translation mode steering angles are the steering angles of the two outboard motors OM observed when the propulsive force action lines 71*s*, 71*p* of the two outboard motors OM cross each other on a line extending anteroposteriorly through the turning center 70 in the hull 2 (on the center line 2*a* when the turning center 70 is on the center line 2*a*). In the non-cooperative mode, the translation mode steering angles without the bow turning of the hull 2 are the steering angles of the two outboard motors OM observed when the propulsive force action lines 71*s*, 71*p* of the two outboard motors OM cross each other at the turning center 70. In the cooperative mode, the translation mode steering angles without the bow turning of the hull 2 are the steering angles of the two outboard motors OM observed when the propulsive force action lines 71*s*, 71*p* of the two outboard motors OM cross each other on the rear side of the turning center 70. In the cooperative mode, the absolute values of the translation mode steering angles may be equal to the absolute values of the maximum steering angles (e.g., mechanical limit steering angles) of the outboard motors OM.

Figure 5C:
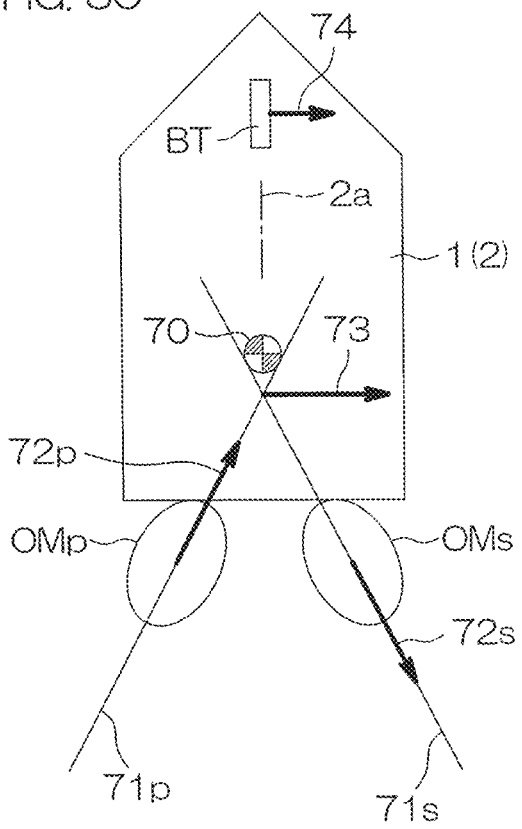
FIGS. 5C and 5D are diagrams for describing examples of the translation with bow turning to be observed in the cooperative mode.
Figure 5D:
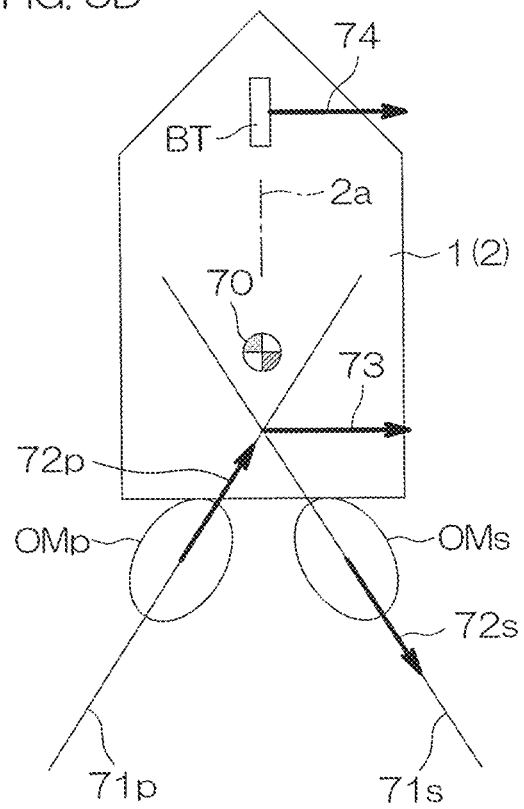

When the joystick 8 is inclined and pivoted, the hull 2 is in a hull behavior such that the bow is turned in a direction corresponding to the pivoting direction of the joystick 8 while the hull 2 is moved in a direction corresponding to the inclination direction of the joystick 8. In the cooperative mode, for example, the hull 2 can be translated with the bow turning depending on the magnitude balance between the propulsive force 74 of the bow thruster BT and the resultant propulsive force 73 of the two outboard motors OM as shown in FIGS. 5C and 5D.

In the non-cooperative mode, though not shown, the hull 2 can be translated with the bow turning by controlling the steering angles of the two outboard motors OM so that the propulsive force action lines 71*s*, 71*p* of the two outboard motors OM cross each other on the front side or the rear side of the turning center 70.

The resultant propulsive force 73 of the two outboard motors OM depends on the directions and the magnitudes of the propulsive forces 72*s*, 72*p* of the outboard motors OM, i.e., the steering angles and the outputs (engine rotation speeds) of the respective outboard motors OM. That is, even with the same engine outputs, the resultant propulsive force 73 is relatively reduced by reducing the absolute values of the steering angles to relatively reduce (or narrow) an angle defined between the two outboard motors OM as shown in FIG. 5C. Further, even with the same engine outputs, the resultant propulsive force 73 is relatively increased by increasing the absolute values of the steering angles to relatively increase (or expand) the angle defined between the two outboard motors OM as shown in FIG. 5D.

When the joystick 8 is pivoted (twisted) without being inclined in the joystick mode, the bow of the hull 2 is turned in a direction corresponding to the pivoting direction of the joystick 8 without any substantial position change. That is, the hull 2 is in a hull behavior of fixed point bow turning. Examples of the fixed point bow turning are shown in FIG. 4B.

At this time, the steering angles of the two outboard motors OM are set to zero, so that the two outboard motors OM generate propulsive forces parallel to the center line 2*a*. That is, the propulsive force action lines of the two outboard motors OM are parallel to the center line 2*a*, i.e., parallel to the anteroposterior direction of the hull 2. The steering angles of the two outboard motors OM observed at this time are hereinafter referred to as "bow turning mode steering angles." For the fixed point bow turning, one of the outboard motors OM is driven forward, and the other outboard motor OM is driven in reverse such that a moment can be applied to the hull 2 about the turning center. For the fixed point bow turning in a leftward direction (in a counterclockwise direction as seen in plan), the starboard-side outboard motor OMs is driven forward, and the port-side outboard motor OMp is driven reverse. For the fixed point bow turning in a rightward direction (in a clockwise direction as seen in plan), the starboard-side outboard motor OMs is driven in reverse, and the port-side outboard motor OMp is driven forward.

In the non-cooperative mode, the bow thruster BT is in the stop state. In the cooperative mode, the bow thruster BT also generates a propulsive force to promote the bow turning. That is, the bow thruster BT applies a leftward propulsive force to the hull 2 for the fixed point bow turning in the leftward direction (in the counterclockwise direction as seen in plan). For the fixed point bow turning in the rightward direction (in the clockwise direction as seen in plan), the bow thruster BT applies a rightward propulsive force to the hull 2.

The fixed point holding mode (Stay Point™), the position holding mode (Fish Point™) and the azimuth holding mode (Drift Point™) to be respectively selected by operating the holding mode setting buttons 182, 183, and 184 (see FIG. 3) as described above are examples of the holding mode. In these holding modes, the propulsive forces and the steering angles of the outboard motors OM are controlled without any manual operation by the user. In the cooperative mode, the propulsive force of the bow thruster BT is also controlled.

In the fixed point holding mode (Stay Point™), for example, the main controller 50 controls the outputs and the steering angles of the outboard motors OM based on the position data and the speed data generated by the GPS receiver 52 and the azimuth data outputted by the azimuth sensor 53. In the cooperative mode, the propulsive force of the bow thruster BT is also controlled such that the positional change and the azimuthal change of the hull 2 can be reduced or prevented.

In the position holding mode (Fish Point™), the main controller 50 controls the propulsive forces and the steering angles of the outboard motors OM based on the position data and the speed data generated by the GPS receiver 52. In the cooperative mode, the propulsive force of the bow thruster BT is also controlled such that the positional change of the hull 2 is reduced or prevented. In the position holding mode, the movement direction of the hull 2 is detected, for example, based on a change in the position data generated by the GPS receiver 52. The steering angles of the outboard motors OM are controlled to maintain the azimuth of the hull 2 so as to direct the bow or the stern in the movement direction. With the azimuth of the hull 2 thus maintained, the propulsive forces are applied anteroposteriorly to the hull 2 to maintain the position of the hull 2.

In the azimuth holding mode (Drift Point™), the main controller 50 controls the propulsive forces and the steering angles of the outboard motors OM based on the azimuth data generated by the azimuth sensor 53. In the cooperative mode, the propulsive force of the bow thruster BT is also controlled such that the azimuthal change of the hull 2 is reduced or prevented. In the cooperative mode, the azimuth of the hull 2 may be controlled to be maintained by utilizing only the propulsive force of the bow thruster BT.

Figure 6A:
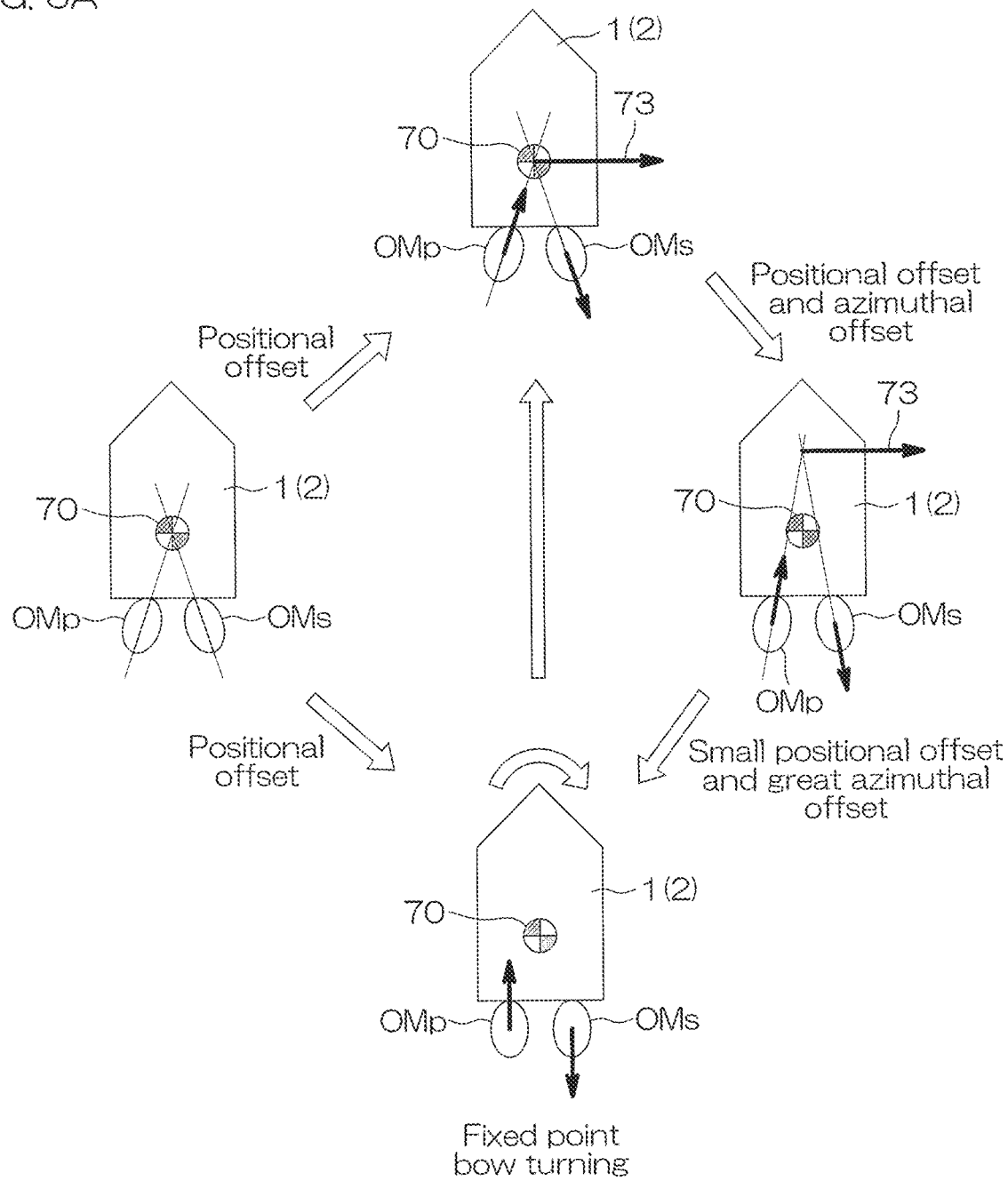
FIG. 6A shows an exemplary control operation to be performed in a fixed point holding mode in the non-cooperative mode.
Figure 6B:
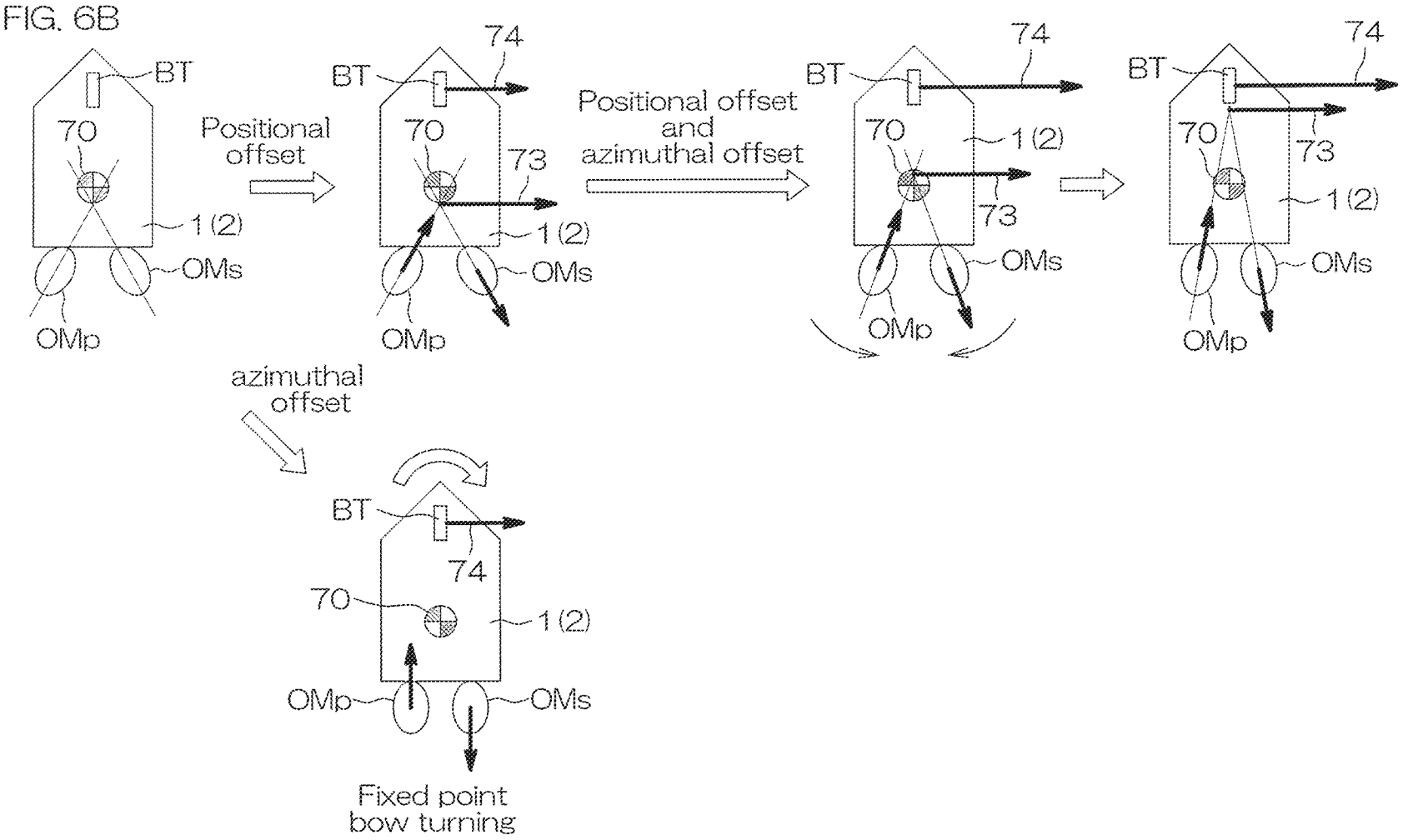
FIG. 6B shows an exemplary control operation to be performed in the fixed point holding mode in the cooperative mode.

FIG. 6A shows an exemplary control operation to be performed in the fixed point holding mode (Stay Point™) in the non-cooperative mode. Further, FIG. 6B shows an exemplary control operation to be performed in the fixed point holding mode (Stay Point™) in the cooperative mode. When the holding mode setting button 182 for the fixed point holding mode is operated to start the fixed point holding mode in either of the non-cooperative mode and the cooperative mode, the main controller 50 acquires the current position of the hull 2 from the GPS receiver 52, and sets the current position as a target position. Further, the main controller 50 acquires the current azimuth (the bow azimuth) of the hull 2 (observed when the holding mode setting button 182 is operated) from the azimuth sensor 53, and sets the current azimuth as a target azimuth. The target azimuth may be finely adjusted by operating the input device 10 or any of the function switches 61. The main controller 50 controls the steering angles of the two outboard motors OM to the translation mode steering angles, and performs a translation control operation to maintain the position of the hull 2 at the target position and performs an azimuth control operation to maintain the azimuth of the hull 2 at the target azimuth.

Referring to FIG. 6A, the exemplary control operation to be performed in the non-cooperative mode will first be described.

If the offset of the actual hull azimuth detected by the azimuth sensor 53 from the target azimuth (azimuthal offset) is within an azimuthal offset allowance and the actual position of the hull 2 detected by the GPS receiver 52 is offset from the target position by greater than a positional offset allowance, a positional offset compensation control operation is performed. That is, the translation control operation is performed to translate the hull 2 to the target position with the azimuth of the hull 2 maintained. In this case, the steering angles of the two outboard motors OM are controlled so that the propulsive force action lines of the outboard motors OM cross each other at the turning center 70. Then, one of the two outboard motors OM is driven forward, and the other outboard motor OM is driven in reverse. At the same time, the propulsive forces of the two outboard motors OM are properly controlled. Thus, the hull 2 can be translated to the target position without the bow turning of the hull 2.

If the positional offset of the hull 2 is greater than the positional offset allowance and the actual azimuth of the hull 2 detected by the azimuth sensor 53 is offset from the target azimuth by greater than the azimuthal offset allowance, an azimuthal offset compensation control operation is also performed. Specifically, the steering angles of the two outboard motors OM are controlled to be maintained at the translation mode steering angles with the intersection of the propulsive force action lines of the two outboard motors OM being offset forward or rearward from the turning center 70. Thus, the resultant propulsive force 73 of the two outboard motors OM causes the hull 2 to translate, and applies a moment to the hull 2 about the turning center 70. As a result, both the translation control operation and the azimuth control operation are performed such that the hull 2 is moved to the target position and the bow is turned to the target azimuth.

If the actual azimuth of the hull 2 detected by the azimuth sensor 53 is offset from the target azimuth by a predetermined mode switching threshold that is greater than the azimuthal offset allowance, a fixed point bow turning control operation is performed to prioritize the azimuthal offset compensation. That is, the fixed point bow turning control operation (a kind of the azimuth control operation) is performed to turn the bow of the hull 2 to the target azimuth. In this case, the steering angles of the two outboard motors OM are controlled to the bow turning mode steering angles so that the propulsive force action lines of the two outboard motors OM are parallel to the center line 2*a*. Then, one of the two outboard motors OM is driven forward, and the other outboard motor OM is driven in reverse such that the bow of the hull 2 is turned to the target azimuth with the position of the hull 2 fixed. When the offset of the azimuth from the target azimuth falls within the azimuthal offset allowance, the steering angles of the two outboard motors OM are returned to the translation mode steering angles.

During the fixed point bow turning control operation, the hull position maintaining control is stopped so that the position of the hull 2 is liable to be significantly changed by the influence of external disturbance (wind and water current).

Referring to FIG. 6B, the exemplary control operation to be performed in the cooperative mode will next be described.

If the offset of the actual azimuth of the hull 2 detected by the azimuth sensor 53 from the target azimuth is within the azimuthal offset allowance and the actual position of the hull 2 detected by the GPS receiver 52 is offset from the target position by greater than the positional offset allowance, the positional offset compensation control operation is performed. That is, the translation control operation is performed to translate the hull 2 to the target position with the azimuth of the hull 2 maintained. In this case, the steering angles of the two outboard motors OM are controlled so that the propulsive force action lines of the outboard motors OM cross each other on the rear side of the turning center 70. Then, one of the two outboard motors OM is driven forward, and the other outboard motor OM is driven in reverse. In this state, the propulsive forces of the two outboard motors OM and the bow thruster BT are properly controlled. Thus, the hull 2 can be translated to the target position without the bow turning of the hull 2.

If the positional offset of the hull 2 is greater than the positional offset allowance and the actual azimuth of the hull 2 detected by the azimuth sensor 53 is offset from the target azimuth by greater than the azimuthal offset allowance, the azimuthal offset compensation control operation is also performed. Specifically, the steering angles of the two outboard motors OM are controlled to be maintained at the translation mode steering angles with the intersection of the propulsive force action lines coinciding with the turning center 70. Thus, the resultant propulsive force 73 of the two outboard motors OM causes the hull 2 to translate, and applies no moment to the hull 2. On the other hand, the bow thruster BT is driven to generate the propulsive force, thus applying a moment to the hull 2 about the turning center 70. As a result, the translation control operation and the azimuth control operation are both performed by utilizing the outboard motors OM and the bow thruster BT, respectively, such that the hull 2 is moved to the target position and the bow of the hull 2 is turned to the target azimuth.

If it is impossible to reduce the azimuthal offset only by the moment applied by the propulsive force of the bow thruster BT, the propulsive forces of the outboard motors OM may be partially used for the bow turning of the hull 2. In this case, the steering angles of the two outboard motors OM are controlled to be maintained at the translation mode steering angles with the intersection of the propulsive force action lines of the two outboard motors OM being offset forward or rearward from the turning center 70. Thus, the resultant propulsive force 73 of the two outboard motors OM causes the hull 2 to translate, and applies a moment to the hull 2 about the turning center 70. Since the moment is applied to the hull 2 by the propulsive forces of the outboard motors OM and the bow thruster BT, the azimuthal offset can be reduced.

If the actual azimuth of the hull 2 detected by the azimuth sensor 53 is offset from the target azimuth by the predetermined mode switching threshold that is greater than the azimuthal offset allowance, the fixed point bow turning control operation is performed for the azimuthal offset compensation. That is, the fixed point bow turning control operation (a kind of the azimuth control operation) is performed to turn the bow of the hull 2 to the target azimuth. In this case, the steering angles of the two outboard motors OM are controlled to the bow turning mode steering angles so that the propulsive force action lines of the two outboard motors OM are parallel to the center line 2*a*. Then, the forward driving and the reverse driving of the two outboard motors OM are properly controlled, and the bow thruster BT generates the propulsive force in a proper direction such that the bow of the hull 2 is turned to the target azimuth with the position of the hull 2 fixed. When the azimuthal offset from the target azimuth falls within the azimuthal offset allowance, the steering angles of the two outboard motors OM are returned to the translation mode steering angles.

As in the non-cooperative mode, the hull position maintaining control is stopped during the fixed point bow turning control operation so that the position of the hull 2 is liable to be significantly changed by the influence of the external disturbance. In the cooperative mode, however, a greater moment can be applied to the hull 2 by the propulsive force of the bow thruster BT. Therefore, the azimuth is less liable to be significantly offset so the azimuthal offset does not easily exceed the mode switching threshold. Therefore, the fixed point bow turning control operation is unlikely to be performed. This makes it possible to highly precisely maintain the hull 2 at the target position at the target azimuth.

In the non-cooperative mode, the propulsive forces of the outboard motors OM are used to maintain the position of the hull 2 and to maintain the azimuth of the hull 2 and, therefore, are less usable for the azimuthal offset compensation when the steering angles of the outboard motors OM are set to the translation mode steering angles. Therefore, the azimuthal offset is more likely to exceed the mode switching threshold so that the fixed point bow turning control operation is more likely to be performed with the steering angles of the outboard motors OM set to the bow turning mode steering angles. This may possibly increase the positional offset of the hull 2 during the fixed point bow turning control operation. In the cooperative mode, the functions of the outboard motors OM and the bow thruster BT can be properly allocated for the positional offset compensation and for the azimuthal offset compensation. Therefore, the azimuthal offset is unlikely to be increased so that the switching to the fixed point bow turning control operation is unlikely to occur. This makes it possible to highly precisely maintain the position and the azimuth of the hulls 2.

In the following description, a control mode in which the steering angles of the outboard motors OM are set to the translation mode steering angles for the fixed point holding control is referred to as "translation mode" and a control mode in which the steering angles of the outboard motors OM are set to the bow turning mode steering angles for the fixed point holding control is referred to as "bow turning mode."

Figure 7:
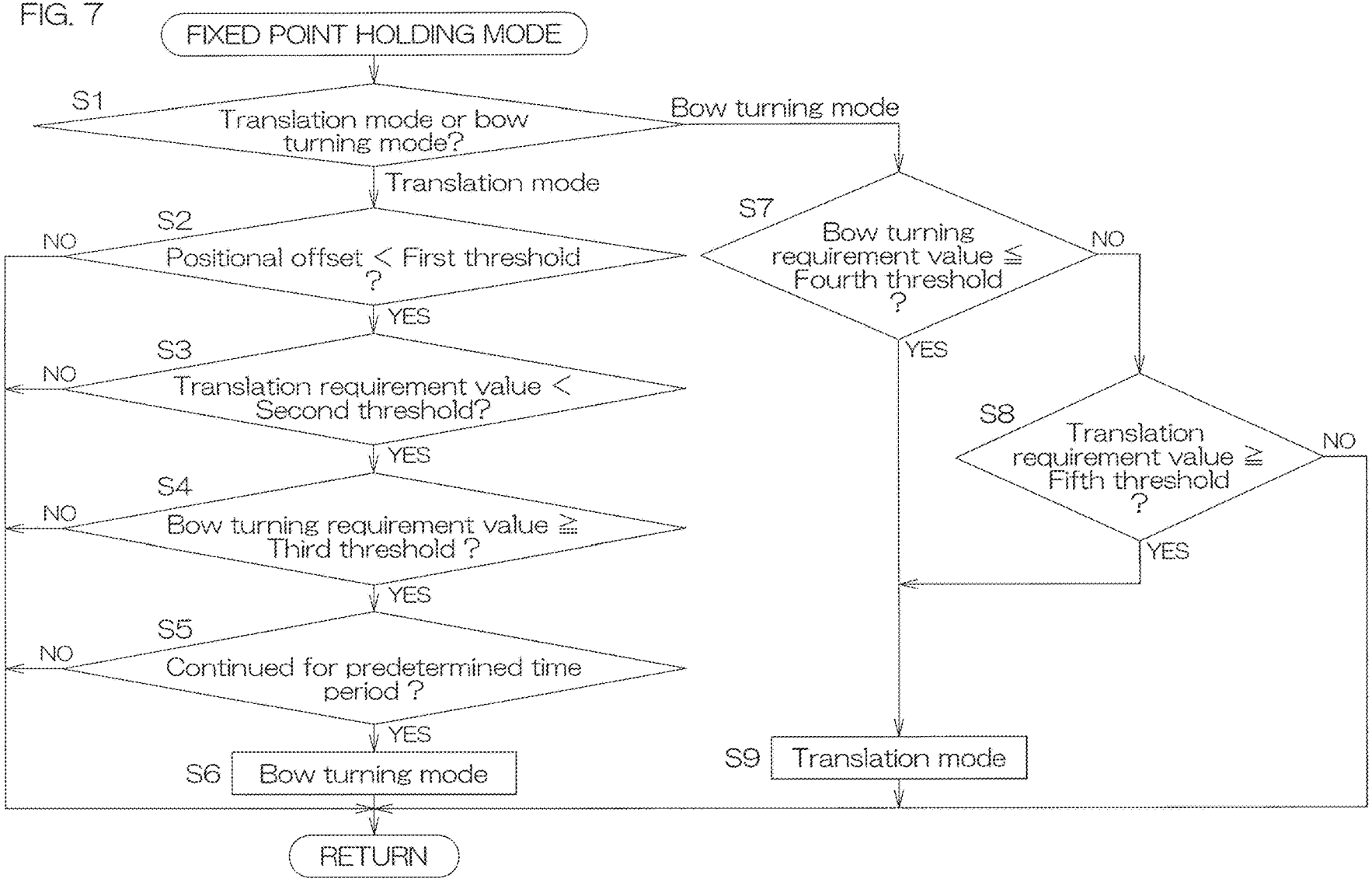
FIG. 7 is a flowchart for describing switching between a translation mode and a bow turning mode in the fixed point holding mode by way of example.

FIG. 7 is a flowchart for describing switching between the translation mode and the bow turning mode in the fixed point holding mode by way of example. The main controller 50 is programmed to switch between the translation mode and the bow turning mode based on a predetermined switching condition in the fixed point holding mode (Stay Point™). An initial mode when the fixed point holding mode is started may be the translation mode. The switching condition includes bow turning mode switching conditions (Steps S2 to S4) to switch from the translation mode to the bow turning mode. Further, the switching condition includes translation mode switching conditions (Steps S7 and S8) to switch from the bow turning mode to the translation mode.

The bow turning mode switching condition includes, for example, at least one of the following first, second, and third switching conditions:

First switching condition (Step S2): The offset of the current position of the hull 2 from the target position (positional offset) is less than a first threshold;

Second switching condition (Step S3): A propulsive force requirement value to translate the hull 2 (translation requirement value) is less than a second threshold; and Third switching condition (Step S4): A bow turning requirement value for the bow turning of the hull 2 (or the azimuthal offset) is not less than a third threshold.

In the translation mode (Step S1), whether or not the bow turning mode switching condition is satisfied is determined. The bow turning mode switching condition may be such that the first switching condition, the second switching condition, and the third switching condition are kept satisfied for not shorter than a predetermined time period (e.g., several seconds) (Step S5). Where the bow turning mode switching condition is such that all the first, second, and third switching conditions are kept satisfied for not shorter than the predetermined time period, the switching from the translation mode to the bow turning mode is less likely to occur. If the bow turning mode switching condition is satisfied, the translation mode is switched to the bow turning mode (Step S6). The determination order for the first switching condition (Step S2), the second switching condition (Step S3) and the third switching condition (Step S4) is not necessarily required to be the one shown in FIG. 7.

The main controller 50 determines the propulsive force requirement value to translate the hull 2 according to the positional offset of the hull 2 from the target position, and then generates the propulsive force command and the steering angle command according to the propulsive force requirement value. Therefore, the propulsive force requirement value is reduced as the positional offset decreases. Further, if the positional offset is not reduced or is increased due to a greater influence of the external disturbance, the main controller 50 increases the propulsive force requirement value for the translation by feedback control based on the positional offset. Therefore, the propulsive force requirement value is also increased or reduced according to the degree of the external disturbance.

If the positional offset is reduced (first switching condition) or if the propulsive force requirement value for the translation is reduced (second switching condition), the movement speed of the hull 2 is reduced, and the course keeping performance of the hull 2 is reduced. Further, if the azimuthal offset of the hull 2 from the target azimuth is increased, the bow turning requirement value is increased (third switching condition). Therefore, where at least one of the first, second, and third switching conditions to be satisfied in these situations is used as the bow turning mode switching condition, the translation mode can be properly switched to the bow turning mode. The third switching condition may be such that the bow turning requirement value is not less than the third threshold, or may be such that the azimuthal offset is not less than the third threshold. The mode switching threshold corresponds to the third threshold.

In this preferred embodiment, if the first, second, and third switching conditions are all kept satisfied for not shorter than the predetermined time period (YES in Step S5), the translation mode is switched to the bow turning mode (Step S6). Therefore, the translation mode is less liable to be switched to the bow turning mode in which the positional offset is likely to occur, so that the fixed point holding control is performed dominantly in the translation mode in which the position and the azimuth of the hull 2 can be highly precisely adjusted.

The translation mode switching condition includes, for example, at least one of the following fourth and fifth switching conditions.

Fourth switching condition (Step S7): The bow turning requirement value for the bow turning of the hull 2 (or the azimuthal offset) is not greater than a fourth threshold; and Fifth switching condition (Step S8): The propulsive force requirement value to translate the hull 2 (translation requirement value) is not less than a fifth threshold.

In the bow turning mode (Step S1), whether or not the translation mode switching condition is satisfied is determined. The translation mode switching condition may be such that at least one of the fourth switching condition or the fifth switching condition is satisfied. Thus, the switching from the bow turning mode to the translation mode is more likely to occur. If the translation mode switching condition is satisfied, the bow turning mode is switched to the translation mode (Step S9). The determination order for the fourth switching condition (Step S7) and the fifth switching condition (Step S8) is not necessarily required to be the one shown in FIG. 7.

In the cooperative mode, the main controller 50 determines the bow turning requirement value, for example, according to the azimuthal offset of the hull 2 from the target azimuth, and generates the propulsive force command according to the bow turning requirement value and applies the propulsive force command to the motor controller 43 of the bow thruster BT. As required, the main controller 50 further controls the propulsive forces and/or the steering angles of the outboard motors OM based on the bow turning requirement value to control the moment to be applied to the hull 2. As the azimuthal offset decreases, the bow turning requirement value is reduced. If the azimuthal offset is not reduced or is increased due to a greater influence of the external disturbance, the main controller 50 increases the bow turning requirement value by feedback control based on the azimuthal offset. Therefore, the bow turning requirement value is also increased or reduced according to the degree of the external disturbance.

If the azimuthal offset of the hull 2 from the target azimuth is reduced (fourth switching condition), it is no longer necessary to apply a greater bow turning moment in the bow turning mode. Further, when the propulsive force requirement value for the translation is great (fifth switching condition), the translation mode is advantageous to prioritize the positional offset compensation. Therefore, where at least one of the fourth and fifth switching conditions to be satisfied in these situations is used as the translation mode switching condition, the bow turning mode can be properly switched to the translation mode. The fourth switching condition may be such that the bow turning requirement value is not greater than the fourth threshold, or may be such that the azimuthal offset is not greater than the fourth threshold.

In this preferred embodiment, if at least one of the fourth switching condition (Step S7) or the fifth switching condition (Step S8) is satisfied, the bow turning mode is switched to the translation mode (Step S9). Therefore, the bow turning mode in which the positional offset is likely to occur is more liable to be switched to the translation mode in which the position and the azimuth of the hull 2 can be highly precisely adjusted so that the fixed point holding control is performed dominantly in the translation mode. Thus, the fixed point holding operation can be performed to highly precisely maintain the position and the azimuth of the hull 2.

The fourth threshold is preferably not greater than the third threshold. Where the fourth threshold is less than the third threshold, hysteresis can be introduced into the mode switching. Similarly, the fifth threshold is preferably not less than the second threshold. Where the fifth threshold is greater than the second threshold, hysteresis can be introduced into the mode switching.

Figure 8:
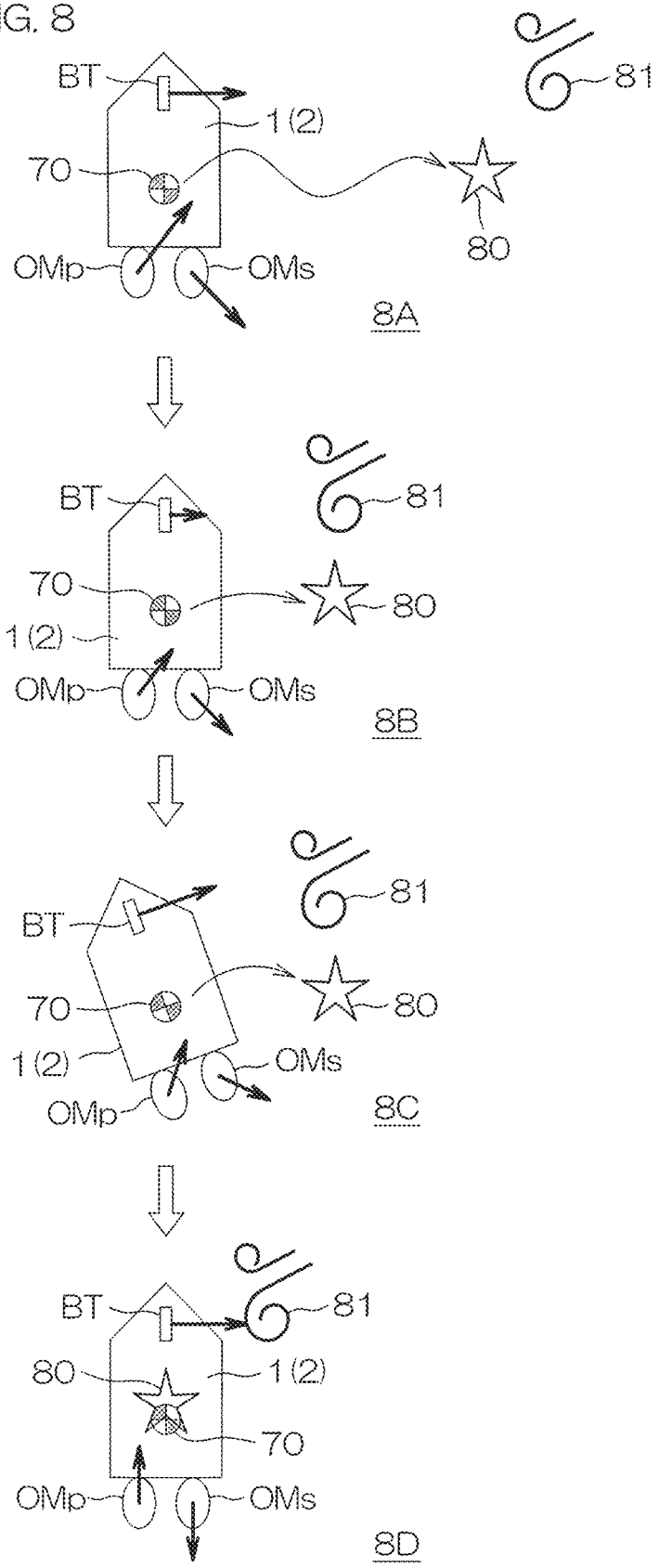
FIG. 8 shows a specific example of the hull behavior to be observed in the fixed point holding mode in the cooperative mode.

FIG. 8 shows a specific example of the hull behavior to be observed in the fixed point holding mode in the cooperative mode. By performing the control operation according to the translation mode, the hull 2 is translated toward a target position 80 against external disturbance 81 (wind or water current) such that the offset of the position of the hull 2 from the target position 80 (positional offset) is reduced to not greater than the first threshold (a change from State 8A to State 8B in FIG. 8). If the external disturbance is not great, the magnitude of the propulsive force required for the translation (i.e., the propulsive force requirement value) is reduced to less than the second threshold as the hull 2 approaches the target position 80. If the movement speed of the hull 2 is correspondingly reduced, the course keeping performance is deteriorated (State 8C in FIG. 8). In this case, the hull 2 is translated by the resultant propulsive force of the outboard motors OM, and the bow of the hull 2 is turned to the target azimuth by the propulsive force of the bow thruster BT. Even in this case, the control mode is still the translation mode. If the azimuthal offset is not reduced or is increased by the propulsive force of the bow thruster BT, the bow turning requirement value is increased to not less than the third threshold. At this time, if a state in which the positional offset, the propulsive force requirement value, and the bow turning requirement value are not greater than the first threshold, not greater than the second threshold, and not less than the third threshold, respectively, continues for the predetermined time period, the translation mode is switched to the bow turning mode (State 8D in FIG. 8). Thus, the propulsive forces of the outboard motors OM also apply moments to the hull 2 so that the azimuth of the hull 2 can be speedily adjusted to the target azimuth. Thus, the control mode can be returned to the translation mode in a relatively short period of time after the bow turning mode.

Even if the bow turning requirement value (or the azimuthal offset) is great when the positional offset is relatively great (first switching condition) or when the propulsive force requirement value for the translation is great (second switching condition), the translation mode is not switched to the bow turning mode, but maintained. Even in the translation mode, a great moment can be applied to the hull 2 by the propulsive force of the bow thruster BT. Therefore, the switching to the bow turning mode is less liable to occur. Thus, the positional offset can be eliminated as much as possible which may otherwise occur during the bow turning mode, so that the fixed point holding control can be highly precisely performed. Further, the outboard motors OM and the bow thruster BT apply moments to the hull 2 in the bow turning mode such that the azimuthal offset can be speedily reduced. Therefore, the control operation in the bow turning mode can be finished in a short period of time to switch from the bow turning mode to the translation mode. Thus, the positional offset in the bow turning mode can be reduced. This is also contributable to the highly precise fixed point holding control.

Figure 9:
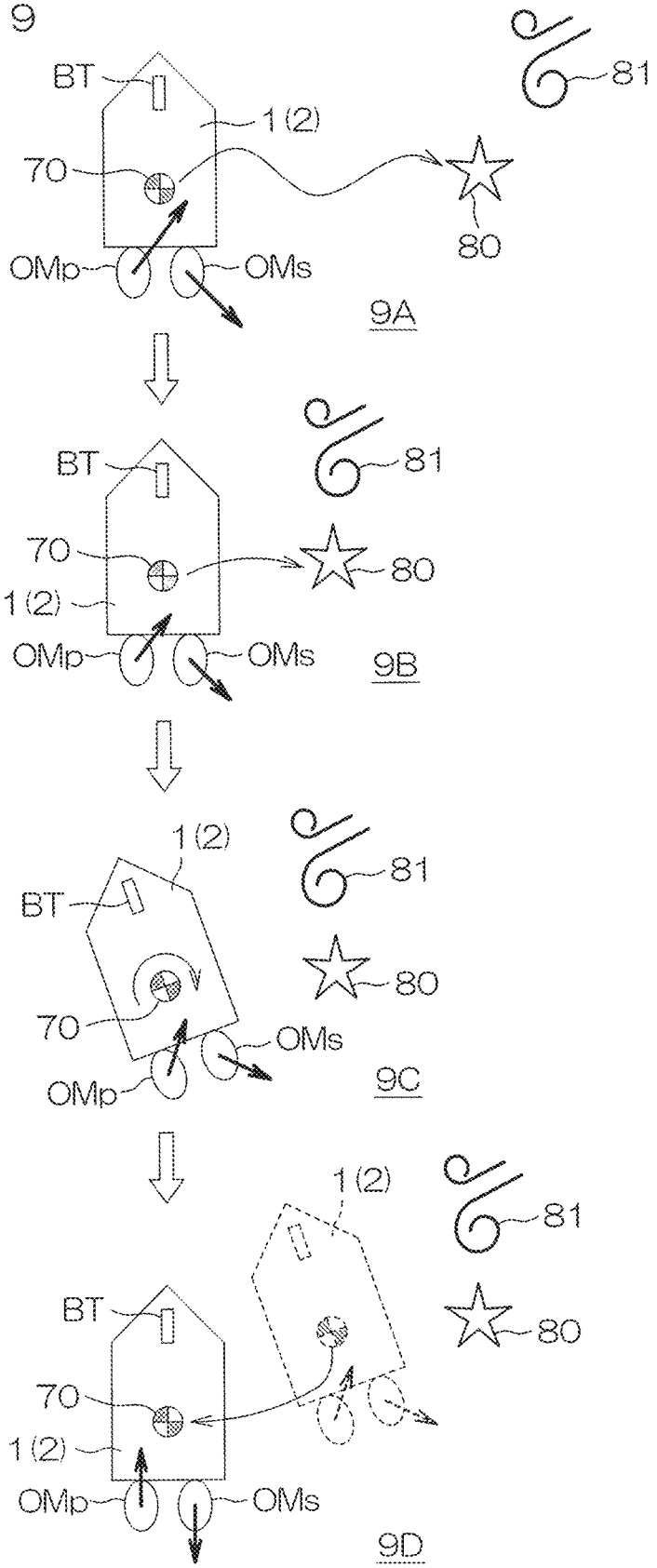
FIG. 9 shows a specific example of the hull behavior to be observed in the fixed point holding mode in the non-cooperative mode.

FIG. 9 shows a specific example of the hull behavior to be observed in the fixed point holding control in the non-cooperative mode. Since the bow thruster BT is in the stop state, the translation and the bow turning of the hull 2 are controlled solely by the propulsive forces of the outboard motors OM in the translation mode. By performing the control operation according to the translation mode, the hull 2 is translated toward a target position 80 against external disturbance 81 (wind or water current) such that the offset of the position of the hull 2 from the target position 80 (positional offset) is reduced to not greater than the first threshold (a change from State 9A to State 9B in FIG. 9). Further, if the wind or the water current are not strong, the magnitude of the propulsive force required for the translation (i.e., the propulsive force requirement value) is reduced to less than the second threshold, as the hull 2 approaches the target position. If the movement speed of the hull 2 is correspondingly reduced, the course keeping performance is deteriorated, so that the azimuthal offset is liable to be increased (State 9C in FIG. 9). If the azimuthal offset is increased, and a state in which the bow turning requirement value, the positional offset, and the propulsive force requirement value are not less than the third threshold, not greater than the first threshold, and not greater than the second threshold, respectively, continues for not less than the predetermined time period, the translation mode is switched to the bow turning mode (State 9D in FIG. 9). Thus, the propulsive forces of the outboard motors OM also apply moments to the hull 2 so that the azimuth of the hull 2 can be adjusted to the target azimuth.

Even if the azimuthal offset (bow turning requirement value) is great when the positional offset is relatively great (first switching condition) or when the propulsive force requirement value is great (second switching condition), the translation mode is not switched to the bow turning mode, but is maintained. In the non-cooperative mode, however, the propulsive force of the bow thruster BT is not contributable to the bow turning of the hull 2, so that the azimuthal offset is liable to be increased. Therefore, the switching to the bow turning mode is liable to quickly and frequently occur. It is impossible to apply the propulsive force to the hull 2 to translate the hull 2 in the bow turning mode, so that the positional offset is liable to occur due to the influence of the external disturbance 81. In addition, it takes time to eliminate the azimuthal offset without the moment generated by the propulsive force of the bow thruster BT. If the external disturbance is great, it may be impossible to finish the bow turning mode in a short period of time. Therefore, the fixed point holding control is less precise in the non-cooperative mode than in the cooperative mode.

While preferred embodiments of the present invention have thus been described, the present invention may be embodied in some other ways.

In a preferred embodiment described above, the two outboard motors OM are provided on the stern 3 by way of example. The number of the outboard motors OM may be one, or three or more. In a preferred embodiment described above, the engine outboard motors are used as the propulsion devices by way of example, but instead electric outboard motors may be employed. Further, the propulsion devices are not necessarily required to be the outboard motors, but may be inboard motors, inboard/outboard motors (stern drives), waterjet propulsion devices and other types of propulsion devices.

In a preferred embodiment described above, the bow thruster BT is able to generate the propulsive force only laterally leftward and rightward by way of example.

Alternatively, a steerable propulsion device such as an electric trolling motor may be provided at the bow instead of the propulsion device that is able to generate the propulsive force only laterally leftward and rightward. That is, the bow thruster may be a propulsion device provided at the bow and able to generate the propulsive force laterally leftward and rightward and further generate the propulsive force in directions other than the leftward and rightward directions.

In a preferred embodiment described above, the watercraft propulsion system 100 includes the cooperative mode in which the outboard motors OM and the bow thruster BT are controlled in a cooperative manner, and the non-cooperative mode in which the cooperative control is not performed by way of example. However, the non-cooperative mode may be omitted.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a bow thruster at a bow of a hull to generate a lateral propulsive force;

a propulsion device on a stern of the hull and having a variable steering angle; and a controller configured or programmed to control the propulsive force of the bow thruster, and control the steering angle and a propulsive force of the propulsion device in order to perform a fixed point holding control to maintain a position and an azimuth of the hull; wherein the fixed point holding control includes a translation mode in which the hull position is maintained by controlling the propulsive force of the propulsion device with the steering angle of the propulsion device set to a translation mode steering angle to translate the hull and the hull azimuth is adjusted by controlling the propulsive force of the bow thruster, and a bow turning mode in which the hull azimuth is adjusted by controlling the propulsive forces of the bow thruster and the propulsion device with the steering angle of the propulsion device set to a bow turning mode steering angle to bow turn the hull.

2. The watercraft propulsion system according to claim 1, wherein the controller is configured or programmed to switch between the translation mode and the bow turning mode based on a predetermined switching condition during the fixed point holding control.

3. The watercraft propulsion system according to claim 2, wherein the switching condition includes a bow turning mode switching condition to switch from the translation mode to the bow turning mode; and the bow turning mode switching condition includes at least one selected from the group consisting of a first switching condition such that a positional offset of the hull from a target position is less than a first threshold, a second switching condition such that a propulsive force requirement value to translate the hull is less than a second threshold, or a third switching condition such that a bow turning requirement value for the bow turning of the hull or an azimuthal offset of the hull from a target azimuth is not less than a third threshold.

4. The watercraft propulsion system according to claim 3, wherein the bow turning mode switching condition includes a condition such that the first switching condition, the second switching condition, and the third switching condition are continuously satisfied for not shorter than a predetermined time period.

5. The watercraft propulsion system according to claim 2, wherein the switching condition includes a translation mode switching condition to switch from the bow turning mode to the translation mode; and the translation mode switching condition includes at least one of a fourth switching condition such that a bow turning requirement value to turn the bow of the hull or an azimuthal offset of the hull from a target azimuth is not greater than a fourth threshold, and a fifth switching condition such that a propulsive force requirement value to translate the hull is not less than a fifth threshold.

6. The watercraft propulsion system according to claim 5, wherein the bow turning mode is switched to the translation mode if at least one of the fourth switching condition or the fifth switching condition is satisfied.

7. The watercraft propulsion system according to claim 1, wherein the propulsion device includes at least two propulsion devices each having a variable steering angle; and the translation mode steering angle includes translation mode steering angles such that propulsive force action lines of the two propulsion devices cross each other in the hull.

8. The watercraft propulsion system according to claim 7, wherein the translation mode steering angle includes translation mode steering angles such that the propulsive force action lines of the two propulsion devices cross each other at a position closer to the stern than to a turning center of the hull.

9. The watercraft propulsion system according to claim 1, wherein the propulsion device includes at least two propulsion devices each having a variable steering angle; and the bow turning mode steering angle includes bow turning mode steering angles such that propulsive force action lines of the two propulsion devices are parallel or substantially parallel to each other.

10. The watercraft propulsion system according to claim 1, wherein the propulsion device includes at least two propulsion devices each having a variable steering angle; and one of the two propulsion devices is driven forward and the other of the two propulsion devices is driven in reverse in the translation mode and the bow turning mode.

11. A watercraft comprising:

a hull; and the watercraft propulsion system according to claim 1 on the hull.

* * * * *